US005413124A

United States Patent [19]

Incando

[11] Patent Number: 5,413,124

[45] Date of Patent: May 9, 1995

[54] HAIR WEFT AND EXTENSION METHOD AND ARTICLE

[76] Inventor: Peter A. Incando, P.O. Box 292685, Sacramento, Calif. 95829-2685

[21] Appl. No.: 106,914

[22] Filed: Aug. 13, 1993

[51] Int. Cl.[6] ..... A41G 5/00

[52] U.S. Cl. ..... 132/201; 132/56

[58] Field of Search ..... 132/53, 54, 56, 201

[56] References Cited

U.S. PATENT DOCUMENTS

| | | | |
|---|---|---|---|
| 1,490,466 | 4/1924 | Hupka | 132/53 |
| 1,740,764 | 12/1929 | Bong | 132/56 |
| 3,162,203 | 12/1964 | Cramer | 132/53 |
| 3,716,065 | 2/1973 | Finamore | 132/53 |
| 3,889,695 | 6/1975 | Incando | 132/53 |
| 4,220,167 | 9/1980 | Newell | 132/7 |
| 4,608,392 | 8/1986 | Jacquet | 514/844 |
| 4,752,467 | 6/1988 | Konrad | 424/70 |
| 4,983,383 | 1/1991 | Maksimoski | 424/70 |
| 4,985,239 | 1/1991 | Yahagi | 424/70 |
| 4,999,195 | 3/1991 | Hayes | 424/114 |
| 5,002,761 | 3/1991 | Mueller | 424/70 |
| 5,006,331 | 4/1991 | Gaskin | 424/70 |

FOREIGN PATENT DOCUMENTS

| | | | |
|---|---|---|---|
| 2060049 | 6/1972 | Germany | 132/53 |
| 2746580 | 6/1978 | Germany | 132/53 |
| 45-26392 | 8/1970 | Japan | 132/53 |
| 484641 | 3/1970 | Switzerland | 132/53 |
| 1280002 | 7/1972 | United Kingdom | 132/53 |

*Primary Examiner*—John G. Weiss
*Attorney, Agent, or Firm*—Bernhard Kreten

[57] ABSTRACT

A method for pressing a hair weft (10) is provided as well as an article of manufacture. The hair Weft (10) includes a weave (50) which connects attached ends (A) of individual hairs (H) to the weave (50). The weave (50) has a vinyl composition (100) applied thereto along a length thereof while the weave (50) is attached to a lower platen (20). Once multiple coats of the vinyl composition (100) have been applied to the weave (50) and allowed to dry, an upper platen (30) is placed over the weave (50). Clamps (34) are then utilized to press the upper platen (30) down onto the lower platen (20) pressing the vinyl composition (100) and weave (50). The resulting pressed weft (10') more securely bonds the hairs (H) to the pressed weave (50') and decreases a thickness of the pressed weave (50'). The hair weft (10') can then be utilized more effectively for a variety of different uses. One use includes attaching the hair (H) of the hair weft (10') to a cap (110) by placing a bead (120) of the vinyl composition (100) upon the cap (110) and then applying the hair weft (10') to the bead (120) and then severing the pressed weave (50') from the hair weft (10') between the bead (120) and the pressed weave (50'). Another use includes placing tape (80) on the natural hair (N) of an individual to the weave (50') through the tape (80). The modified hair weft (10') is more easily handleable and attachable in a variety of different applications.

8 Claims, 9 Drawing Sheets

HAIR WEFT AND EXTENSION METHOD AND ARTICLE

FIELD OF THE INVENTION

The following invention relates to hair wefts for placement upon a person's head. More particularly, this invention relates to a pressing treatment applied to hair wefts, along with a vinyl composition, to make the hair wefts more easily attachable in a greater variety of ways upon the head of a wearer.

BACKGROUND OF THE INVENTION

Hair extensions are known in the art to allow hair to be enhanced as to amount, character, and/or length. Hair wefts capture individual hairs within a weave of fibers that hold the hair at attached ends thereof for easy handling and utilization in a variety of different ways. The weave can be attached directly to a substrate, such as a cap, so that a group of wefts together can form an entire wig. Also, the weave can be coupled to various different substrates such as hair nets or caps to increase the amount of hair that is worn by an individual.

Each weft can include either natural human hair or some other synthetic or natural hair-like substance interwoven into the weave. Hair wefts can also be used to extend existing hair. To extend existing hair, the weave of the weft is attached to existing hair near the scalp of an individual. The wefts then "grow" away from the scalp along with the growth of the natural hair.

While the above-mentioned uses, as well as many others, are possible with existing hair wefts, utilizing hair wefts is an extremely time-consuming process. For instance, applying wefts as hair extensions for existing hair on an entire head of a person often takes as long as five hours. In addition, available hair wefts hold the hair with a weave that allows individual hairs to be dislodged therefrom. This hair loss problem is especially exhibited when the hair of the weft is sewn in place with the sewing thread passing through the weave and disrupting the hair/weave fiber interface.

In some circumstances, tapes are utilized to attach the weave directly to a substrate, or to natural hair attached to the scalp. Currently available hair wefts provide a weave which does not stick effectively to the hair applying tape. Also, the weaves of hair wefts are significantly thicker than the individual hairs themselves. This thickness of the weave prevents multiple wefts from being spaced closely together to provide an appearance of thick hair.

Accordingly, a need exists for an improved hair weft that securely holds individual hairs within the weave, provides a weave of minimum thickness, is composed of a substance which sticks readily to hair-attaching tape and can be utilized in a rapid and convenient manner.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| INVENTOR | U.S. PAT. NO. | ISSUE DATE |
|---|---|---|
| Incando | 3,889,695 | June 17, 1975 |

-continued

| INVENTOR | U.S. PAT. NO. | ISSUE DATE |
|---|---|---|
| Newell | 4,220,167 | September 2, 1980 |
| Jacquet, et al. | 4,608,392 | August 26, 1986 |
| Konrad, et al. | 4,752,467 | June 21, 1988 |
| Maksimoski, et al. | 4,983,383 | January 8, 1991 |
| Yahagi, et al. | 4,985,239 | January 15, 1991 |
| Hayes | 4,999,195 | March 12, 1991 |
| Mueller, et al. | 5,002,761 | March 26, 1991 |
| Gaskin | 5,006,331 | April 9, 1991 |

The patent to Incando (3,889,695) teaches the use of a method and apparatus for making a hair piece. This present invention by the instant inventor is distinguishable from the previous patent to Incando in that, inter alia, it provides a method for improving an already existing hair weft in a manner not taught by the Incando patent (3,889,695).

The other prior art listed above, but not specifically distinguished, diverge even more starkly from this invention than the patent to Incando (3,889,695) distinguished above.

SUMMARY OF THE INVENTION

This invention modifies a hair weft including individual hairs attached at one end to a weave of fibers. Initially, the weave of the hair weft is taped to a lower platen so that the weave stretches linearly between a first end of the weave and a second end of the weave. A liquid vinyl composition is then applied to the weave along its entire length. This vinyl composition includes vinyl compounds in a form which allows the composition to be applied as a liquid, but then the composition hardens when exposed to the air. After the composition dries, an additional layer of the vinyl composition is applied to the weave and dried. After five layers of the vinyl composition have been applied to the weave, and the vinyl composition has dried into the weave, an upper platen is placed over the weave. Clamps are then placed between the upper platen and the lower platen forcing the upper platen and lower platen together. The hair weft is pressed between the upper platen and the lower platen for four hours. The upper platen is then removed.

After application of the vinyl composition layers and pressing between the platens, the weave of the hair weft is thinner than before application of the vinyl compositions. The vinyl composition securely attaches each of the individual hairs to the weave in a substantially parallel orientation and yet provides an elastic bendable coating to the weave allowing the hair weft to be utilized in a variety of different ways.

The hair weft can then be used in one of a variety of treatment plans to increase or lengthen the amount of hair worn on an individual's head. In one treatment, a cap is provided having a contour which approximates a contour of the head of the individual. A linear bead of the vinyl composition is laid down upon the outer surface of the cap. The pressed hair weft is then placed adjacent the bead with the weave above the bead and with the individual hairs of the hair weft adjacent the bead. A polyethylene sheet is then applied on a side of the hair weft opposite the bead and the hair of the hair weft is pressed into the bead. Once the vinyl composition has dried and is securely attached to the hairs of the hair weft, the polyethylene sheet is removed and the hair of the hair weft is cut between the weave and the bead. The hair of the hair weft is then left attached directly to the cap without the weave still attached thereto.

In another treatment, the pressed hair weft is utilized to extend the existing natural hair of an individual. Initially, the weft is fitted with tape attached to a top surface of the weave of the weft. The natural hair is parted between an upper hair segment and a lower hair segment. The weave of the weft is placed with a bottom surface adjacent the lower hair segment slightly below the part. The vinyl composition is placed along the tape. Some natural hair from the upper hair segment is then pulled down over the tape upon the weave. Once the vinyl composition dries, the weft is attached to the natural hair of the upper hair segment. To remove the hair weft, the top surface of the weave can be easily untaped from the tape and reused. The tape is then removed from the hair with an appropriate solvent.

OBJECTS OF THE INVENTION

Accordingly, a primary object of the present invention is to provide a hair weft that exhibits a lesser thickness than other hair wefts and that securely holds the hair to the weave of the hair weft.

Another object of the present invention is to provide a hair weft which is easy to handle.

Another further object of the present invention is to provide a hair weft which can be attached with hair-attachment tape.

Another further object of the present invention is to provide a hair weft that is more easily attachable to substrates for use on the head of an individual.

Another further object of the present invention is to provide a hair weft which is more easily attachable directly to hairs of an individual.

Another further object of the present invention is to provide a hair weft including a composition which allows the weave of the hair weft to be easily flexed.

Another further object of the present invention is to provide a hair weft which is easily manufactured.

Another further object of the present invention is to provide a method for strengthening a hair weft and that more securely attaches hairs of the hair weft to a weave of the hair weft.

Another further object of the present invention is to provide a method for attaching a hair weft to a substrate in a fast and easy manner.

Another further object of the present invention is to provide a method for attaching a hair weft which results in the hair being presented in a natural manner.

Another further object of the present invention is to provide a composition for inclusion with the weave of a hair weft that causes the weave to more securely grasp the hair of the hair weft.

Another further object of the present invention is to provide a method for extending natural hair of an individual with a hair weft attached thereto.

Viewed from a first vantage point, it is an object of the present invention to provide a weft of hair for location upon a person to be treated, the weft including: a plurality of individual hairs, having an attached end and a free end, a weave of fibers, the weave including means to entrain the attached ends of the plurality of individual hairs within the weave, and a means for bonding the attached ends of the plurality of individual hairs to the fibers of the weave; whereby the individual hairs are prevented from being displaced from the weave.

Viewed from a second vantage point, it is an object of the present invention to provide a method for manufacturing a hair weft having a plurality of individual hairs attached to a weave extending perpendicular to the individual hairs, the method including: interweaving the individual hairs with fibers of the weave, applying a bonding composition to the weave, and bonding attached ends of the individual hairs to the fibers of the weave.

Viewed from a third vantage point, it is an object of the present invention to provide a method for attaching a hair weft to a substrate for use upon a person to be treated, including: providing a hair weft with a plurality of individual hairs having an attached end connected to a weave extending perpendicular to the individual hairs, placing a bead of vinyl composition on the substrate, placing the weft adjacent the bead with the weave above the bead and free ends of the individual hairs below the bead, and severing the weave from the weft above the bead; whereby the individual hairs are attached to the substrate without the weave remaining attached to the individual hairs.

These and other objects will be made manifest when considering the following detailed specification when taken in conjunction with the appended drawing figures.

DESCRIPTION OF PREFERRED EMBODIMENTS

Figure 1:
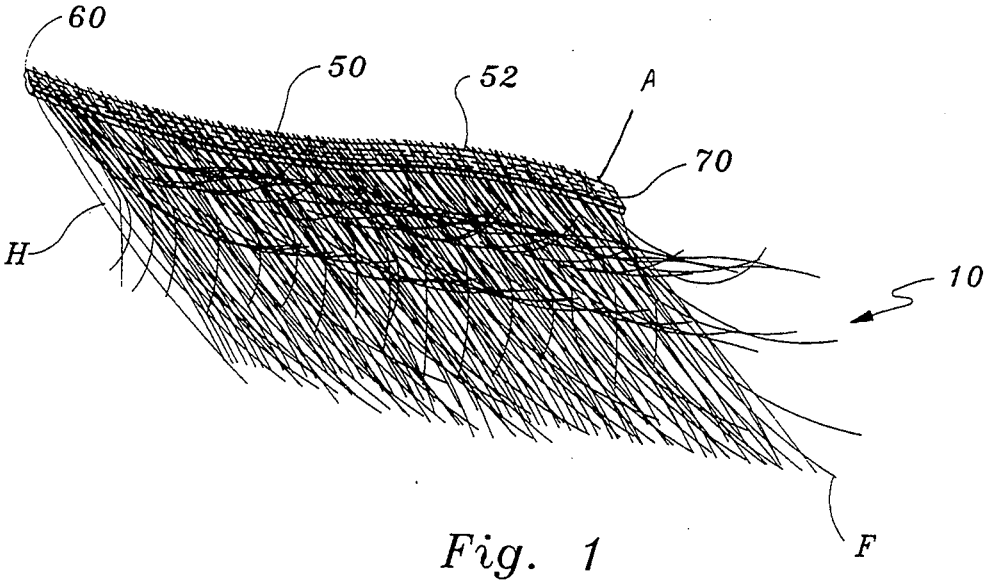
FIG. 1 is a perspective view of a hair weft before treatment according to a method of this invention.

Referring to the drawings, wherein like reference numerals denote like parts throughout, reference numeral 10 (FIG. 1) is directed to a hair weft that can be constructed, modified and applied according to a method of this invention. The hair weft 10 includes a plurality of individual hairs H having free ends F and attached ends A. A weave 50 of fibers is interwoven with the attached ends A of the hairs H.

Figure 2:
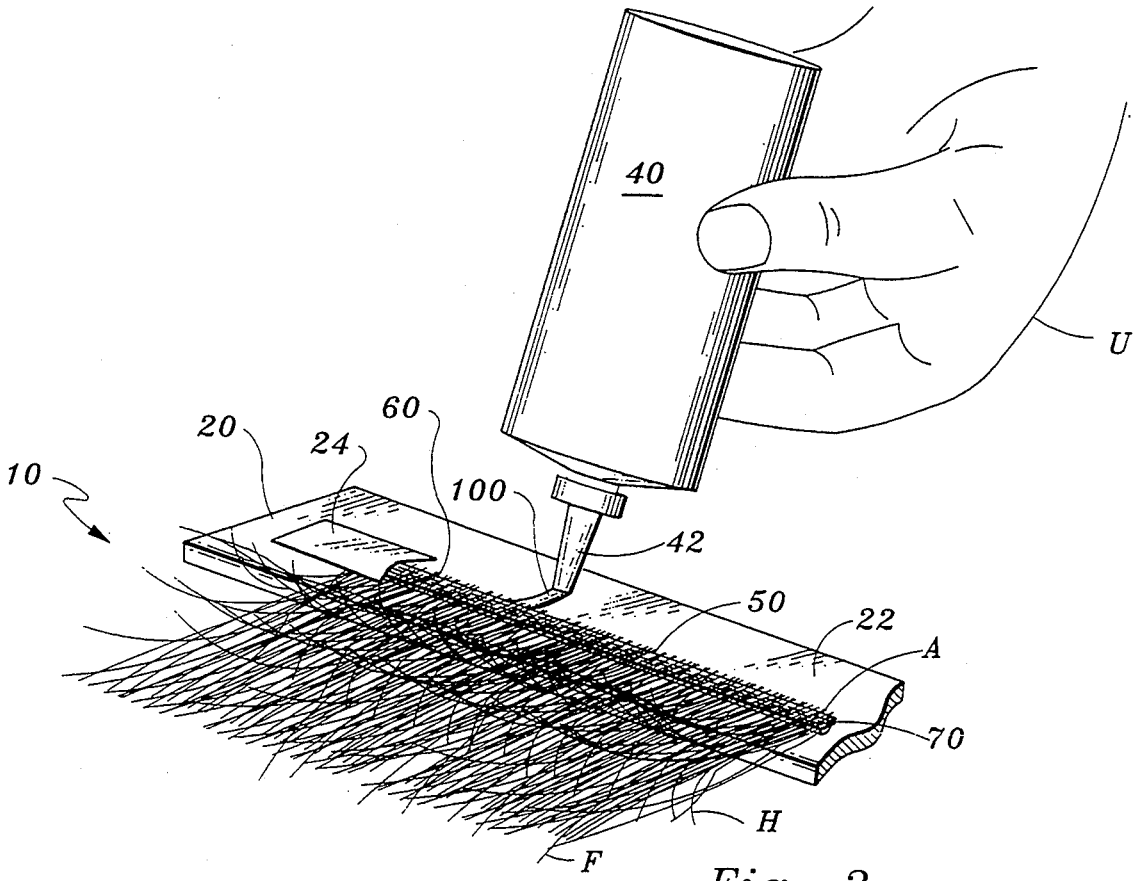
FIG. 2 is a perspective view of a hair weft being treated according to a method of this invention.
Figure 3:
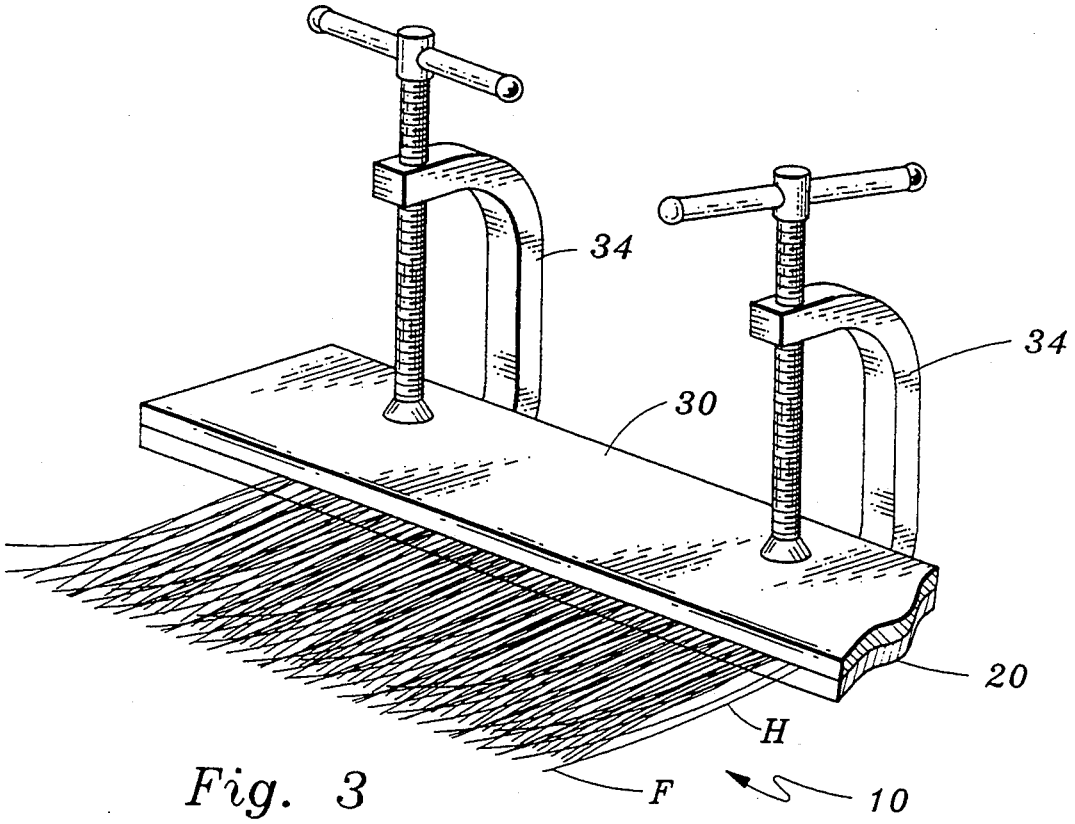
FIG. 3 is a perspective view of a hair weft undergoing further treatment according to the method of this invention.
Figure 13:
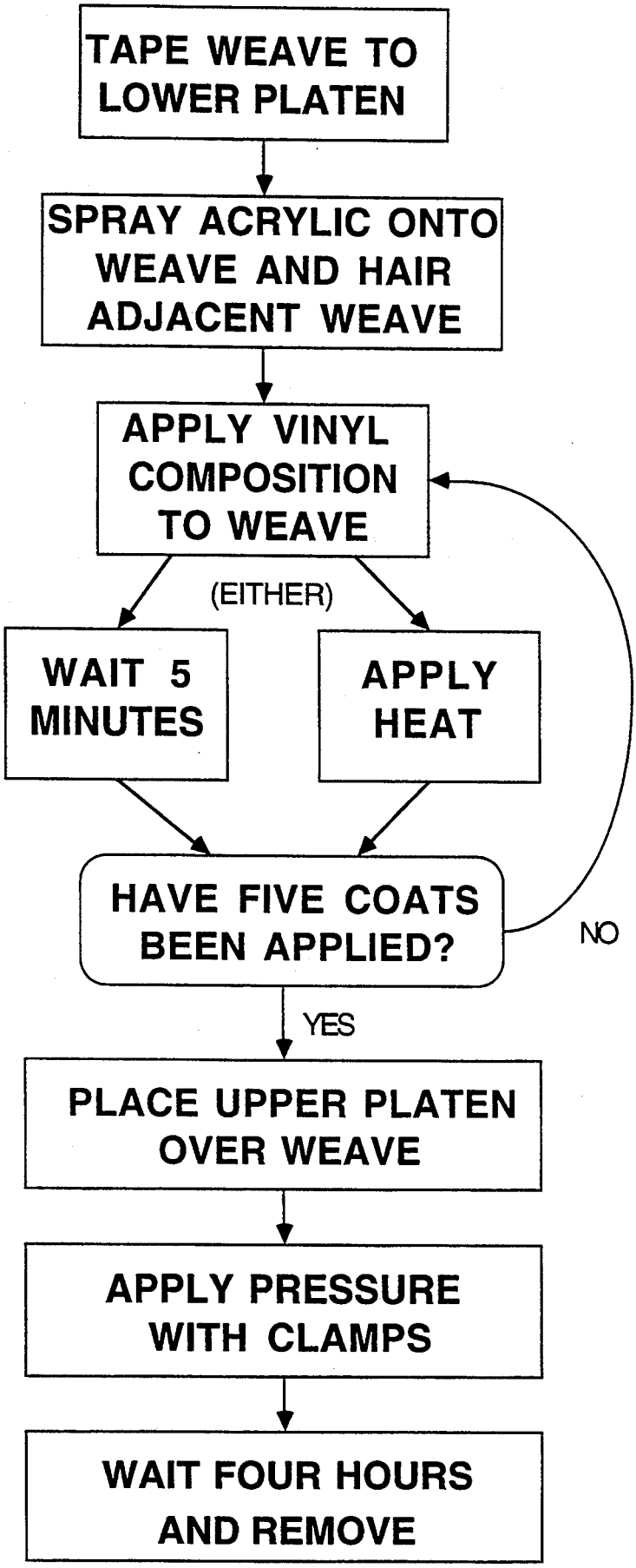
FIG. 13 is a flow chart revealing the steps in the practice of a first method of this invention.
Figure 14:
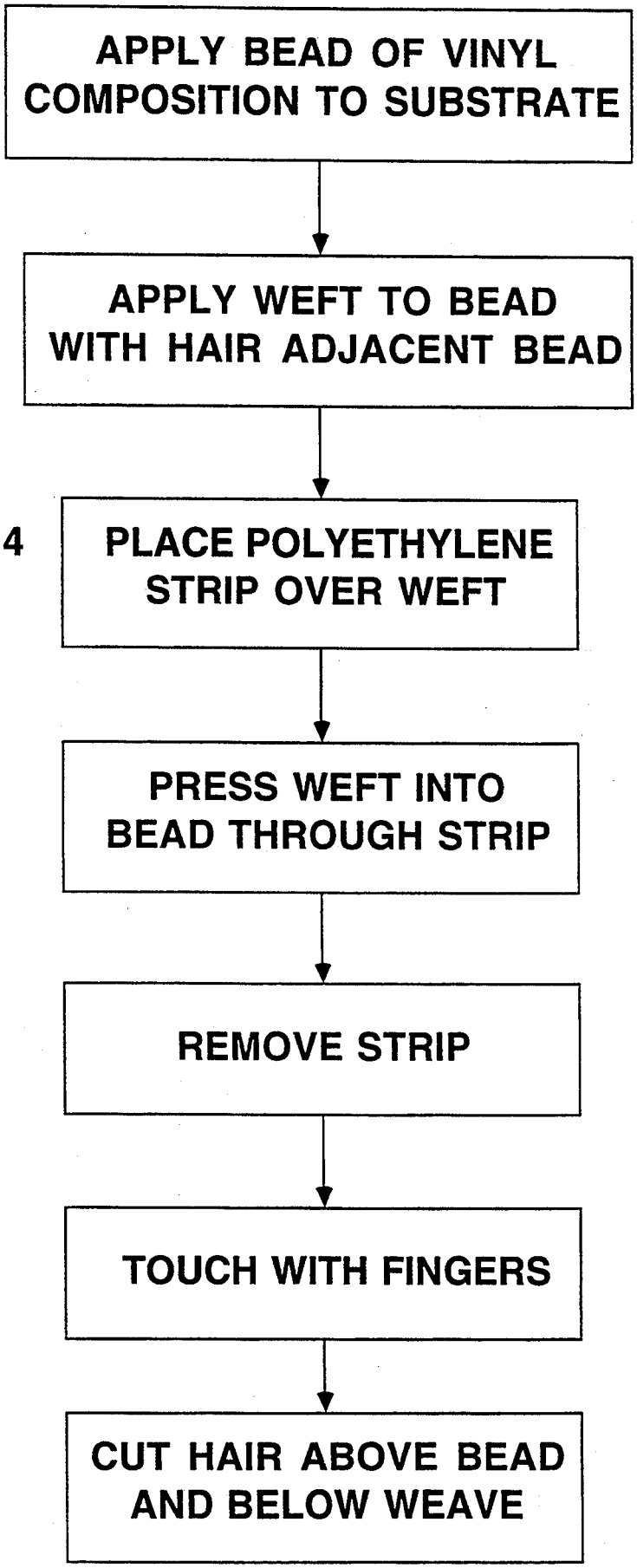
FIG. 14 is a flow chart revealing the steps in the practice of an alternative method of this invention.
Figure 15:
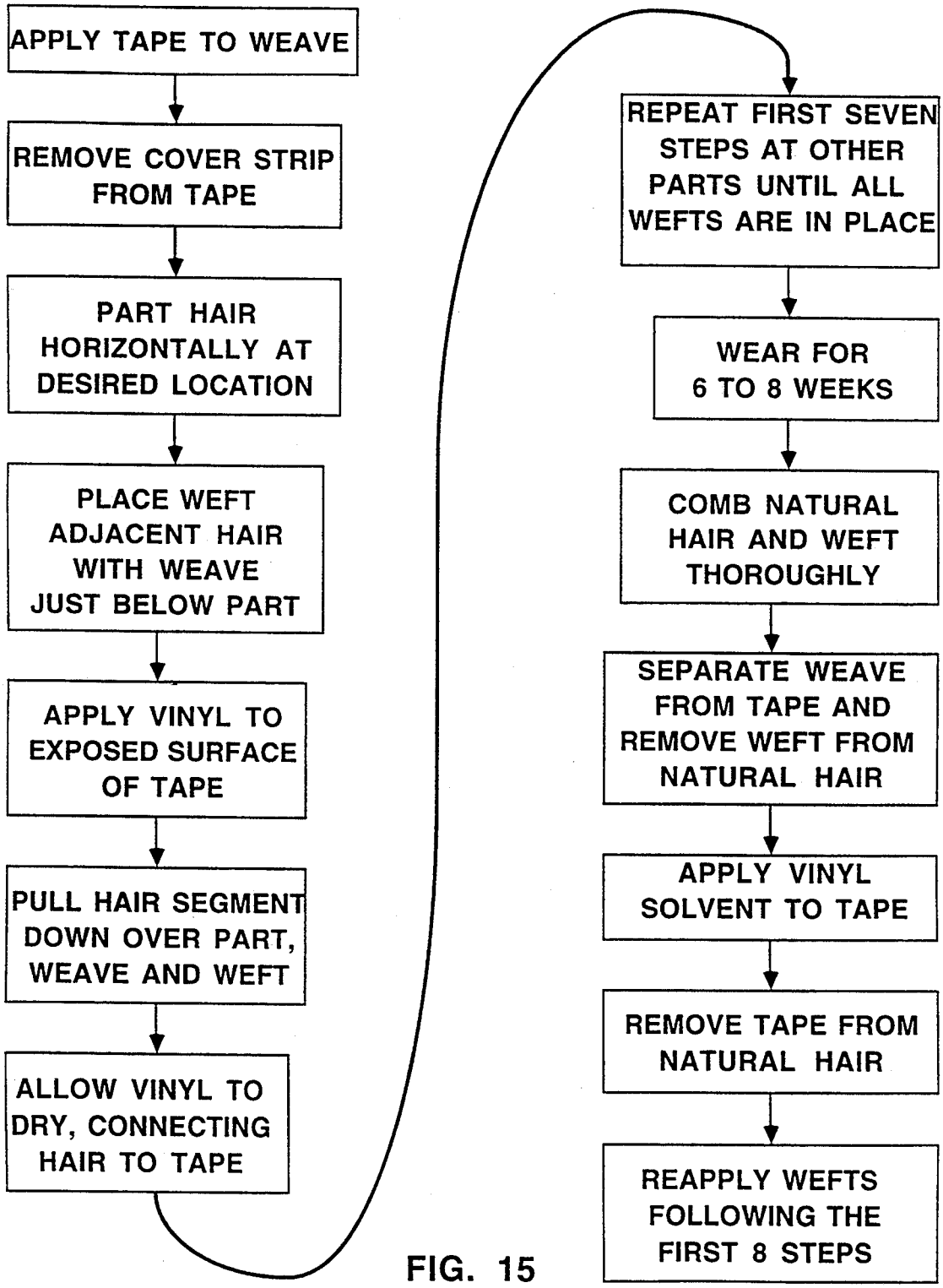
FIG. 15 is a flow chart revealing the steps in the practice of another alternative method of this invention.

In essence, and referring to FIGS. 2, 3 and 13, the hair weft 10 is modified in the following manner. Initially, the weave 50 of the hair weft 10 is taped onto a top surface 22 of a lower platen 20 with tape 24. The weave 50 is stretched linearly along the lower platen 20. A vinyl composition 100 is then applied to the weave 50 by a user U. Application of the vinyl composition 100 provides one form of a means for bonding hairs H to the weave 50. Thus, the vinyl composition 100 acts as a bonding composition.

After the vinyl composition 100 has dried within the weave 50, an upper platen 30 is placed over the weave 50 and clamps 34 apply pressure between the upper platen 30 and the lower platen 20. When the clamps 34 are removed, the weave 50 exhibits a thin pressed configuration. The vinyl 100 securely holds each of the hairs H to the fibers of the pressed weave 50'. When the pressed hair weft 10' has been treated in this manner, individual hairs H are less likely to be dislodged from the pressed weave 50' and the pressed weave 50' exhibits a lesser thickness allowing the hair weft 10 to be more easily utilized for a variety of different applications.

In one application, shown in FIGS. 5 through 8, the pressed hair weft 10' is placed adjacent a bead 120 of the vinyl composition 100 upon a vinyl cap 110. The individual hairs H are pressed into the bead 120 by placing a polyethylene strip 140 over the hairs H and pressing down through the strip 140. The strip 140 is then removed and the hairs H are cut between the weave 50 and a contact line 150 where the hairs H connect to the bead 120 of the vinyl composition 100.

Figure 9:
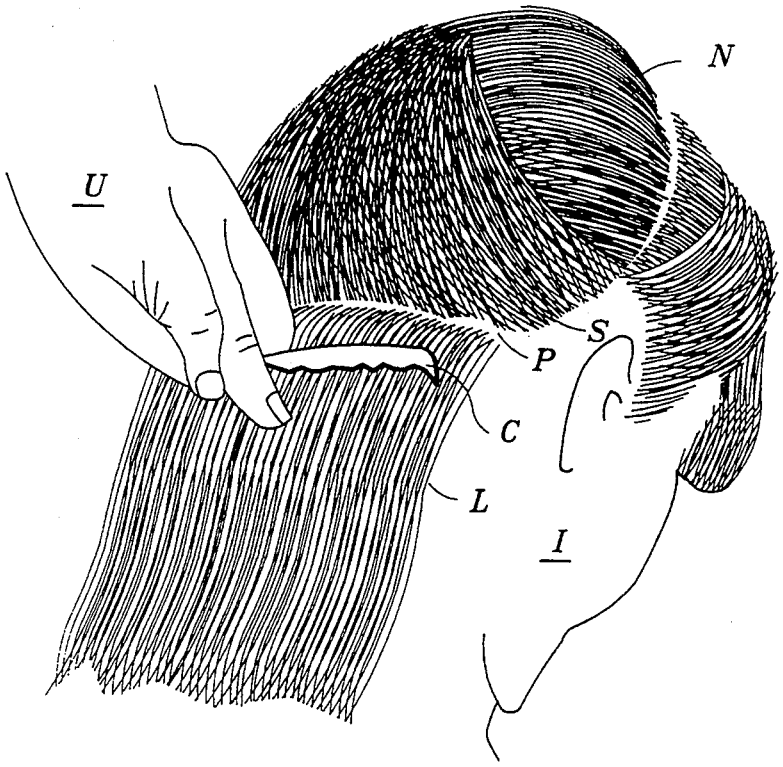
FIG. 9 is a perspective view of an individual prior to receiving a hair extension utilizing a pressed hair weft.
Figure 10:
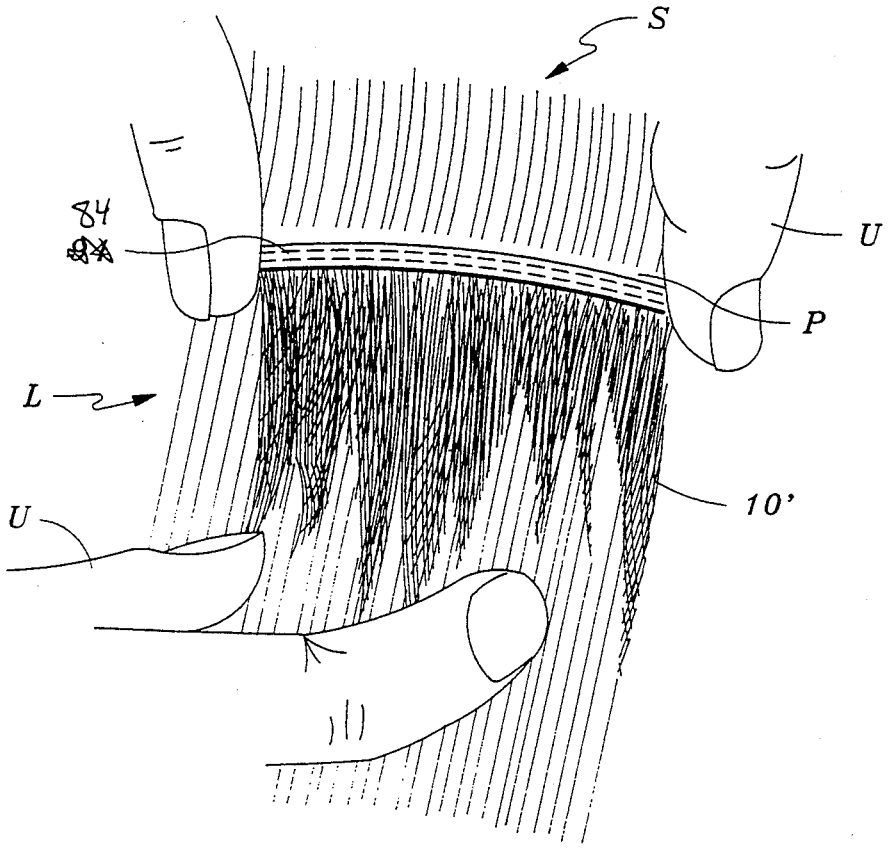
FIG. 10 is a detail of that which is shown in FIG. 9 with a hair weft positioned adjacent the individual.
Figure 11:
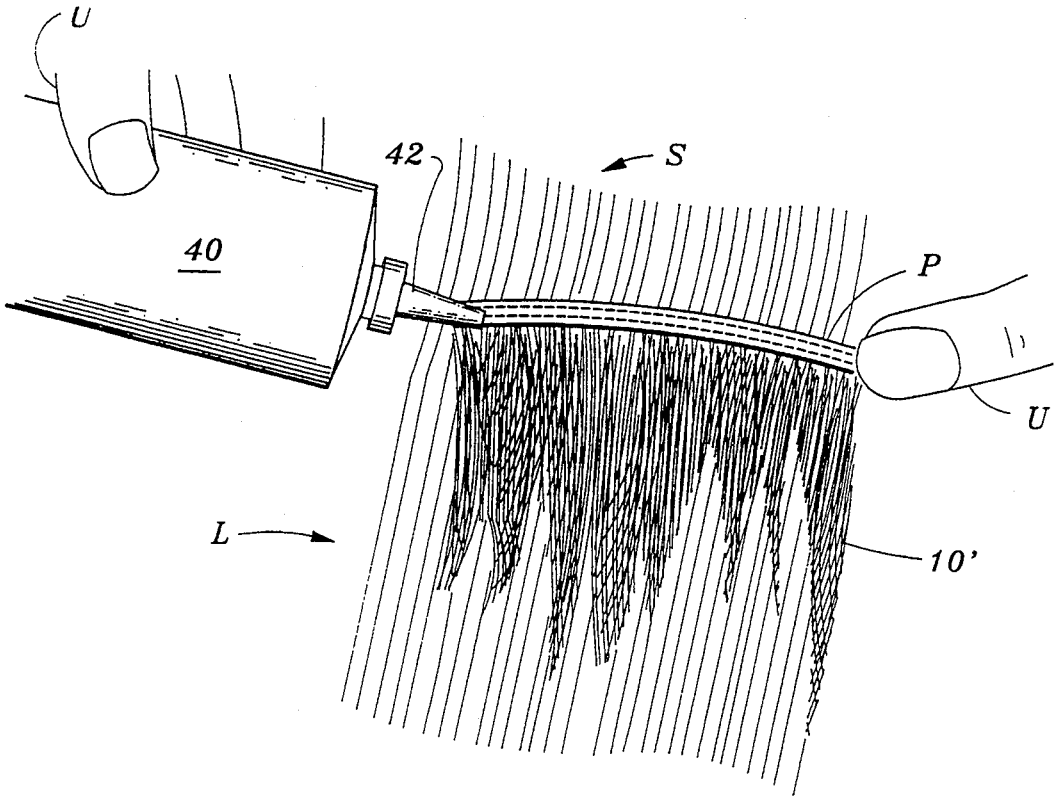
FIG. 11 is a detail of that which is shown in FIG. 9 with a vinyl composition being applied to the hair weft prior to its attachment to natural hair of the individual.
Figure 12:
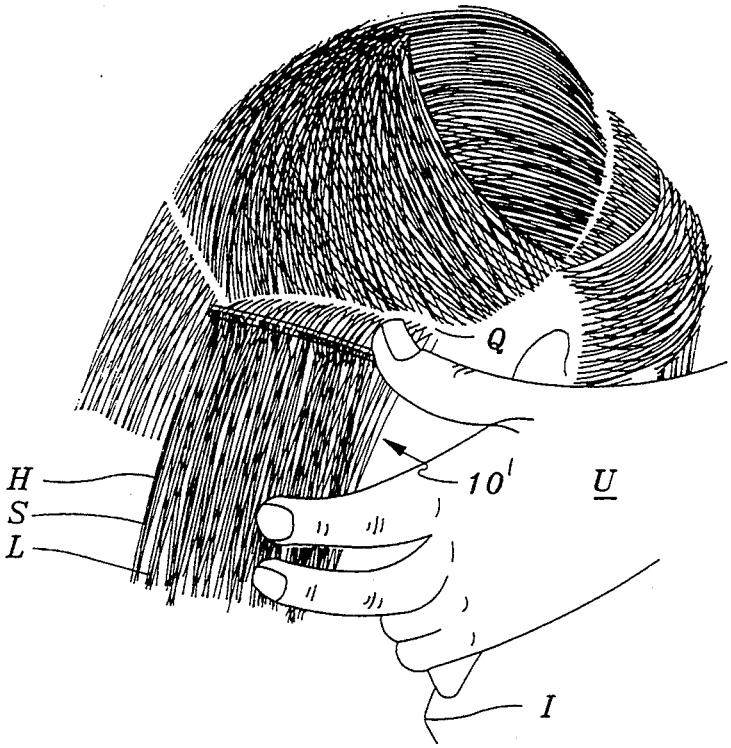
FIG. 12 is a perspective view of the individual after natural hair has been attached to the hair weft.

In a hair extension application, shown in FIGS. 4 and 9 through 12, a tape 80 (FIG. 4) is initially applied to a top surface 51 of the pressed weave 50' of the hair weft 10'. FIG. 9 shows a part P being formed in the natural hair N. As shown in FIGS. 10 through 12, the weft 10' is placed below the part P. Vinyl composition 100 is applied to the tape 80 which is attached to the pressed weave 50'. An upper hair segment S above the part P is then pulled down (FIG. 12) and attached to the tape 80 by the vinyl composition 100. The weft 10' is thus attached directly to natural hair N. When the weft 10' is to be removed, the tape 80 (FIG. 4) is peeled from the pressed weave 50'. The weft 10' can then be reused.

More specifically, and referring in detail to FIGS. 1 through 4 and 13, the hair weft 10 is treated in the following manner, transforming the hair weft 10 into a pressed hair weft 10'. Before treatment, the hair weft 10 (FIG. 1) includes the individual hairs H interwoven with fibers constituting the weave 50. The hairs H are woven into the weave 50 by interweaving woven fibers. The fibers entrain the hairs H within the weave 50 and support the hair H therein. The weave 50 is preferably oriented substantially perpendicular to the hairs H. The weave 50 forms a lattice with the hair H. Stitching 52 can be supplied to further support the hair H within the weave 50.

The weave 50 relies on the tightness of the interwoven fibers and friction between the individual fibers and the hairs H to prevent the hairs H from translating out of the weave 50. The fibers of the weave 50 are generally thicker than the hairs H. The weave 50 thus typically has a greater thickness than do the hairs H extending from the weave 50. As a result, when multiple hair wefts 10 are oriented adjacent each other with the weaves 50 of each hair weft 10 adjacent each other, the hairs H are often not spaced as close as is desired for many uses of the hair wefts 10.

In treatment, the hair weft 10 is placed upon a top surface 22 of a lower platen 20 with the weave 50 extending linearly along a longest dimension of the lower platen 20. The weave 50 is preferably attached to the lower platen 20 with tape 24 attached to a first end 60 of the weave 50 and a second end 70 of the weave 50. The lower platen 20 is preferably a rigid orthorhombic plate of chromium or chromium plated metal. Alternatively, other flat, rigid, substantially "non porous" surfaces could replace the lower platen 20.

The hair weft 10 is oriented on the top 22 of the lower platen 20 with the individual hairs H extending off of the lower platen 20 so that the free ends F of the individual hairs H are not supported upon the lower platen 20. The weave 50 is oriented linearly and the hair H is combed away from the weave 50. Any stray hairs H not alignable with the other hairs H are cut. In one form of this invention, two hair wefts 10 can be placed with the weaves 50 thereof in two parallel rows adjacent each other with the free ends F of each hair weft 10 extending in directions 180° opposed from each other. This allows a single lower platen 20 to support two hair wefts 10 without the hair wefts 10 coming into contact with each other.

Once the hair weft 10 has been attached to the platen 20 with the weave 50 extending linearly along the top surface 22 of the lower platen 20, an acrylic spray is applied to the weave 50 and adjacent hair H of the attached ends A of the hair H. The acrylic spray is allowed to dry on the hair H, preferably with the aid of a hot air hair dryer equipped with a diffuser type nozzle. The acrylic spray penetrates the hair H and acts as a means to prevent the vinyl composition 100 from bleeding into the hair H when the vinyl composition 100 is subsequently applied. This acrylic spray is preferably an acrylic composition formed from the following components:

| Constituent | Range (%) | Preferred (%) |
|---|---|---|
| Isopropanol | 1–5 | 3.109 |
| Acetone | 50–70 | 62.176 |
| Isobutane | 10–30 | 20.725 |
| 2-Propanol 1-Methoxy Acetate | 5–10 | 7.772 |
| Ethylene Glycol Monobutyl Ether | 1–5 | 3.109 |
| Nitrocellulose | 1–5 | 3.109 |
| Fragrance | trace | trace |

Once the hair weft 10 has been sprayed with the acrylic spray, the vinyl composition 100 is mixed, such as by shaking, and is applied to the weave 50 of the hair weft 10. Preferably, the vinyl composition 100 is contained within a bottle 40 having a tip 42 which allows the vinyl composition 100 to exit outwardly therefrom. The tip 42 directs the vinyl composition 100 onto the weave 50 along a length of the weave 50 with the assistance of a user U.

The vinyl composition 100 includes a type of polyvinyl chloride in a form which is liquid when stored within the bottle 40 but rapidly hardens into a elastic solid when exposed to air. Specifically, the vinyl composition 100 includes synthetic resin and tetrahydrofuran (THF). The synthetic resin is preferably a form of polyvinyl chloride that is suspended within the THF. When applied, the THF evaporates, leaving the synthetic resin on the weave 50. The THF thus acts as a highly evaporative solvent that keeps the synthetic resin in liquid form until the THF evaporates.

Preferably, a bead of the vinyl composition 100 is laid down onto the weave 50 in a pattern which extends from the first end 60 to the second end 70 and then returns from the second end 70 back to the first end 60. When this deposition of the vinyl composition 100 is complete, the vinyl composition is allowed to dry within the weave 50 for approximately five minutes. Alternatively, this process can be accelerated by applying heat with various means, such as a hair dryer. When the vinyl composition 100 has dried into the weave 50, a second coat of the vinyl composition 100 is applied to the weave 50 in a manner identical to that involved in applying the first coat of the vinyl composition 100. This coat of the vinyl composition 100 is then dried. Preferably, a third, fourth and fifth coat of the vinyl composition 100 are further applied to the weave 50 of the hair weft 10.

After the final coat of the vinyl composition 100 has been applied to the weave 50 and then dried, an upper platen 30 is placed over the weave 50 of the hair weft 10 adjacent the lower platen 20. The upper platen 30 is preferably an orthorhombic rigid chromium plate similar to that constituting the lower platen 20. The upper platen 30 and lower platen 20 are then pressed together, preferably with clamps 34.

The clamps 34 apply pressure between the upper platen 30 and lower platen 20 causing the weave 50 to take on a reduced thickness. The vinyl composition 100 within the weave 50 is also deformed to a lesser thickness between the upper platen 30 and the lower platen 20. Preferably, the clamps 34 are applied to the weave 50 by beginning at a central location between the first end 60 and second end 70 of the weave 50 and then placing clamps 34 that extend outward toward the first end 60 and second end 70. This clamping pattern assures a uniform weave 50 thickness.

After a sufficient time period has elapsed for the vinyl composition 100 to be permanently reformed into the thinner profile between the platens 20, 30, the platen 30 is removed and the weft 10 is displaced from the lower platen 20. Preferably, at least four hours are provided for the pressing of the weave 50 to be completed. The pressed hair weft 10' is then provided with a pressed weave 50' which is held in a lesser thickness by the vinyl composition 100 having been pressed therewithin.

The "thickness" dimension of the pressed weave 50' is that dimension perpendicular to a longest dimension of the hair H and perpendicular to a longest dimension of the pressed weave 50'. This thinner profile at the weave 50' allows the hair weft 10' to be more tightly spaced with other hair wefts 10'. Furthermore, the vinyl composition 100 adheres the attached ends A of the individual hairs H to the fibers of the weave 50', decreasing the likelihood that individual hairs H will become displaced from the weave 50'.

The vinyl composition 100 is adherable to hair application tape 80 (FIG. 4) commonly used in the hair treatment industry, allowing the pressed hair wefts 10' to be applied with the tape 80. The hair weft 10' can thus be utilized more effectively after treatment with the vinyl composition 100 and pressing between the platens 20, 30 than the hair weft 10 before this treatment.

Some of the uses of the hair weft 10', which benefit from the treatment method described in detail above, include taping the hair wefts 10' to other structures, bonding the hair weft 10' through the pressed weave 50' with a bonding agent, as in applying the hair weft 10' as a hair extension for natural hair of undesirably short lengths, weaving the hair wefts 10' into natural hair, sewing the hair wefts 10' in with natural hair, and attaching hair of the hair weft 10' to a net or cap to be worn as a wig.

Referring now to FIGS. 5 through 8 and 14, details of attachment of the pressed hair weft 10' to a cap 110 are shown in detail. Initially, a bead 120 of the vinyl composition 100 is applied to an outer surface of the cap 110. The cap 110 is preferably formed of a variety of materials including vinyl therein and is figured to fit a contour of an individual's head which is to receive the cap 110. The cap 110 can thus act as a vinyl substrate for the attachment of hair H of the weft 10' thereto. The cap 110 includes an edge 112 circumscribing a bottom thereof. Preferably, the bead 120 is oriented substantially parallel to the edge 112. The vinyl composition 100 is applied to the cap 110 out of a bottle 130 having a tip 132 similar to the bottle 40 and tip 42 of the pressing method described above.

Once the bead 120 has been located upon the cap 110, the hair weft 10' is placed over the bead 120 with the individual hairs H impacting the bead 120 at a location between the attached ends A and the free ends F. A polyethylene sheet 140 is preferably placed overlying the hairs H on a side of the hairs H opposite the bead 120 and pressure is applied through the polyethylene strip 140 pressing the individual hairs H into the bead 120. Preferably, the sheet 140 is formed from polyethylene in that polyethylene does not stick to the bead 120 of the vinyl composition 100. Other substances having similar characteristics could also be used. The polyethylene strip 140 is then removed and the bead 120 is dabbed with fingers of the user U to take a sheen off of the bead 120. The bead 120 connects to the hair H along a contact line 150. The vinyl composition 100 thus acts as a bonding composition bonding hair H to the cap 110 or other desired substrates.

Finally, the hair H is severed between the pressed weave 50' and the contact line 150 along a severance line 160. Preferably, the severance line is directly adjacent to the contact line 150. As a result, the hair H is provided with an appearance that it is coming directly out of the cap 110 and does not include the pressed weave 50' attached thereto. Additional hair wefts 10' can then be applied to other regions upon the cap 110 preferably in a series of tightly spaced concentric circles surrounding the cap 110 and parallel to the edge 112 of the cap 110. In this way, hair H can be very densely attached to the cap 110. By utilizing pressed hair wefts 10', the hair H extends from the cap 100 in a substantially parallel orientation to adjacent hairs H. The pressed weft 10' also presents the hair H in a thin enough layer to ensure that most of the hair H comes into contact with the bead 120.

Referring now to FIGS. 9 through 12 and 15, the pressed hair weft 10' is connected to the natural hair N of an individual I in the following manner. Initially, the natural hair N of the individual I is thoroughly combed and positioned in an arrangement where an upper hair segment S extends upward from a linear first part P and a lower hair segment L extends downward from the first part P. This first part P is located in an area in which a hair weft 10' is to be attached to provide a "hair extension" for the individual I. Preferably, the first part P is oriented substantially horizontally.

Figure 4:
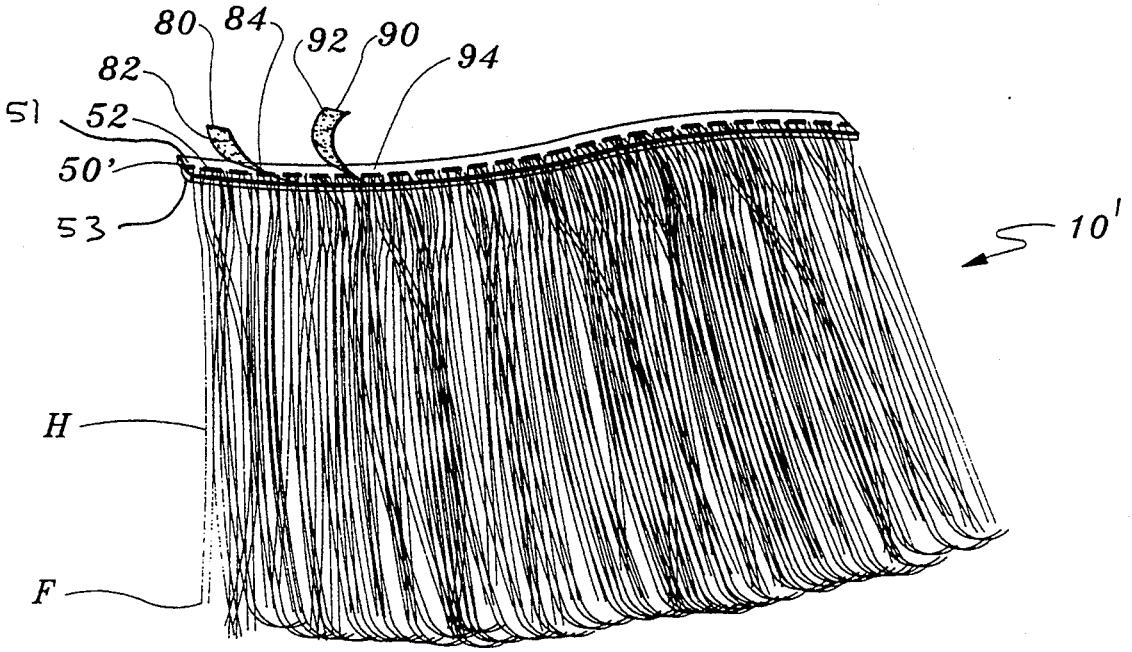
FIG. 4 is a perspective view of a hair weft after treatment according to a method of this invention.
Figure 5:
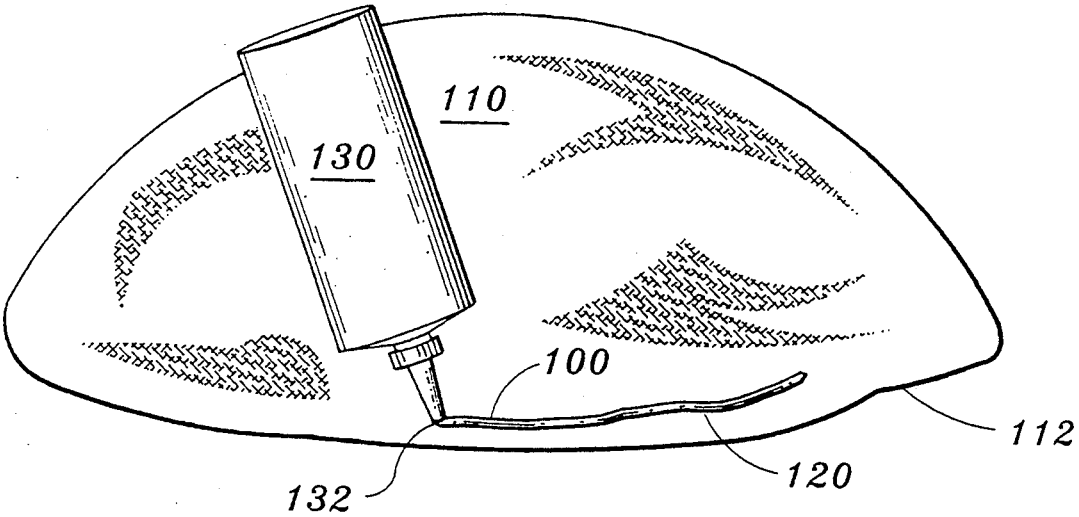
FIG. 5 is a perspective view of a first step in a method of attachment of a hair weft to a substrate.
Figure 6:
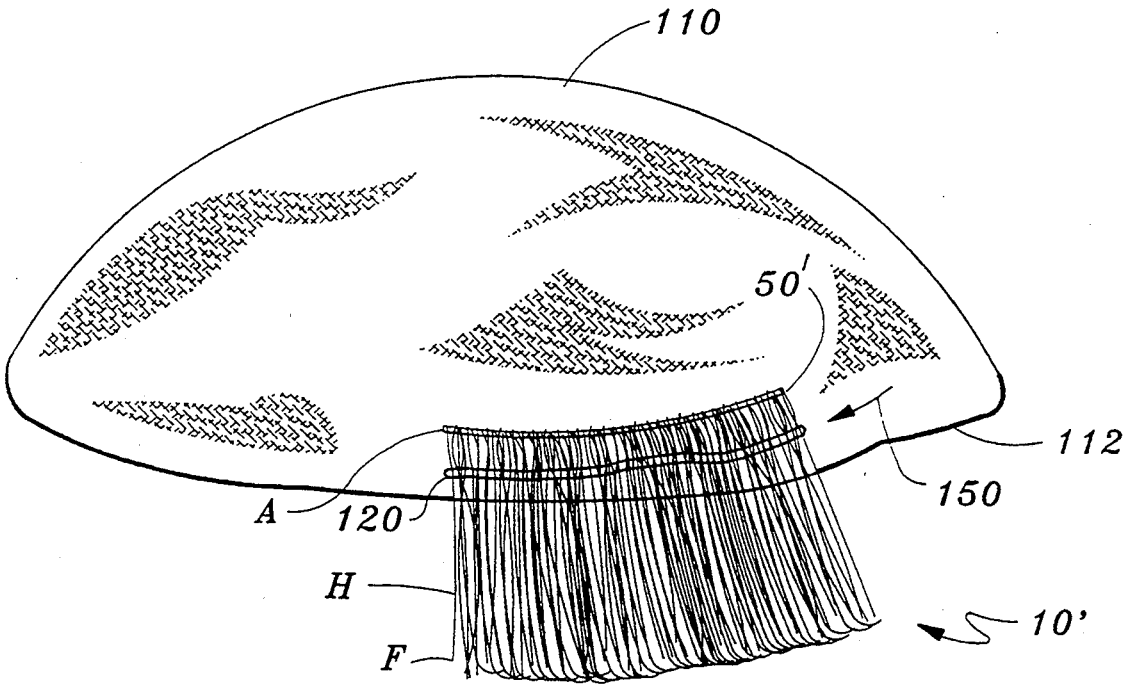
FIG. 6 is a perspective view of a second step in attaching a hair weft to a substrate.
Figure 7:
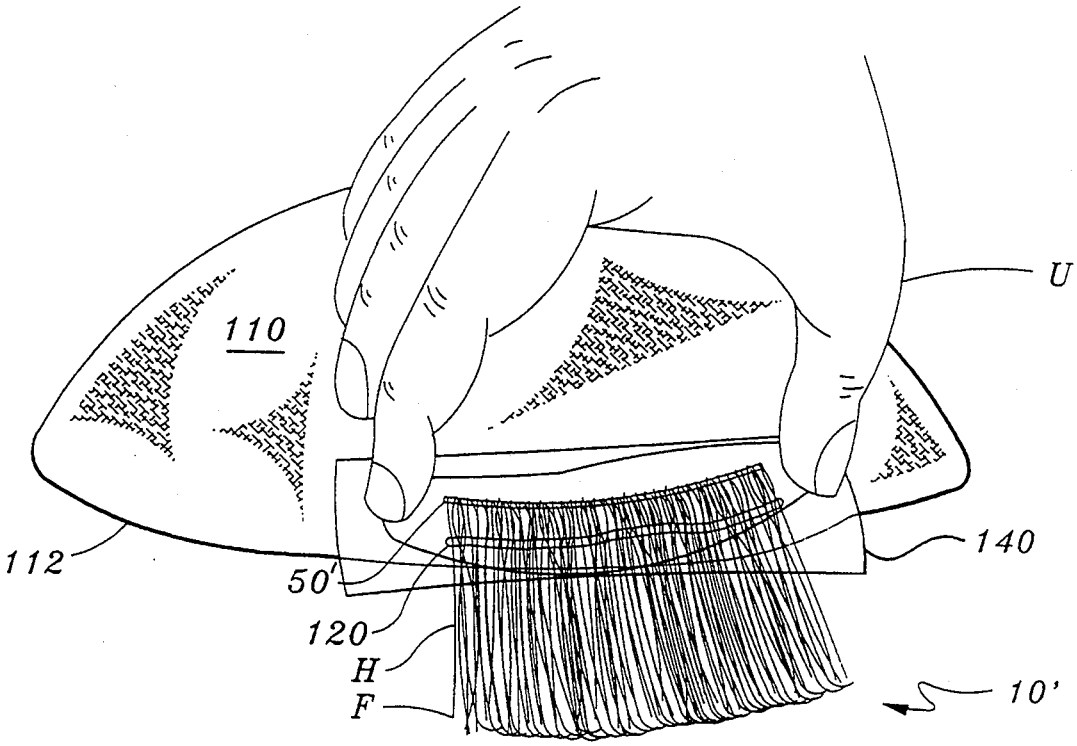
FIG. 7 is a perspective view of a third step in attaching a hair weft to a substrate.
Figure 8:
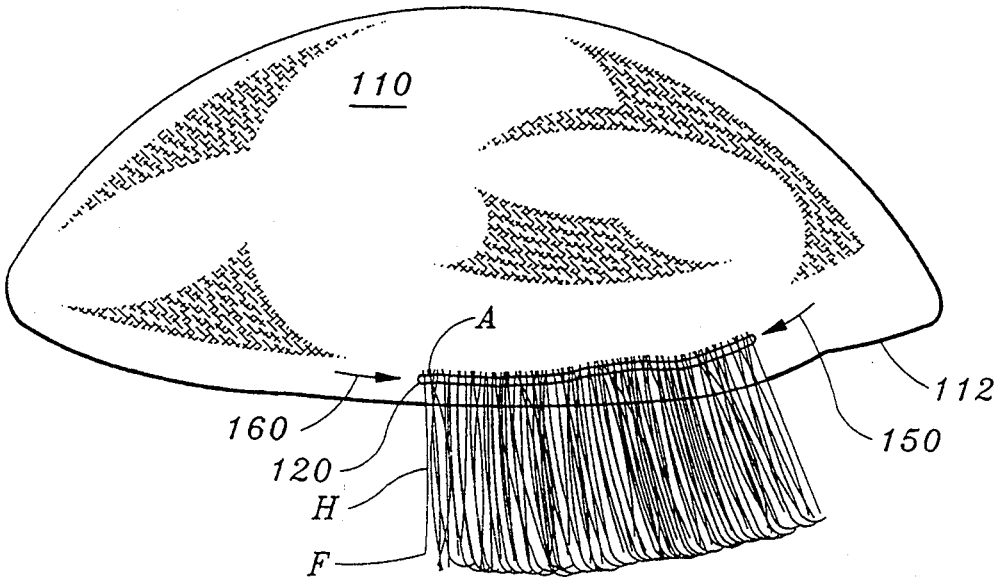
FIG. 8 is a perspective view of a hair weft after attachment to a substrate according to a method of this invention.

The pressed weft 10' is fitted with hair attachment tape 80 attached to the top surface 51 of the pressed weave 50' (FIG. 4). The hair attachment tape 80 is an elongate, thin, clear strip having at least one surface which has an adhesive thereon which readily attaches securely to the vinyl composition 100 within the pressed weave 50'. The tape 80 includes a contact surface 82 which is oriented adjacent the top surface 51 of the pressed weave 50' and which has the adhesive substance thereon. An exposed surface 84 opposite the contact surface 82 can also be supplied with an adhesive to form "double stick" tape 80 (i.e. tape with two adhering surfaces). If the tape 80 is of the double stick variety, a cover strip 90 can be provided overlying the exposed surface 84 of the tape 80. The cover strip 90 includes a first surface adjacent the exposed surface 84 of the tape 80 and a second surface 94 opposite the first surface 92. The cover strip 90 prevents the exposed surface 84 of the tape 80 from losing its adhesive ability through the collection of dust and contact while handling.

To apply the pressed weft 10' to the natural hair N of the individual I, the tape 80 is oriented with its contact surface 82 attached to the top surface 51 of the pressed weave 50' and the cover strip 90 removed from the exposed surface 84. The weft 10' is then located with a bottom surface 53 of the pressed weave 50' opposite the top surface 51 adjacent the lower hair segment L and just below the first part P (FIG. 10). The weft 10 can be either held in place with the hand of the user U or can be held in place with a comb C, such as that shown in FIG. 9.

The vinyl composition 100 is then applied to the exposed surface 84 of the tape 80 which is located upon the top surface 51 of the pressed weave 50'. Once a bead of the vinyl composition 100 has been placed upon the exposed surface 84, a portion of the upper hair segment S, above the first part P, is brought down overlying the pressed weft 10' with the upper hair segment S in contact with the vinyl composition 100 upon the exposed surface 84. When the upper hair segment S is brought down over the first part P, a second part Q is formed above the upper hair segment S.

The natural hair N of the upper hair segment S is allowed to bond with the exposed surface 84 of the tape 80 as the vinyl composition 100 dries. Once the vinyl composition 100 dries, additional hair wefts 10' can be bonded to additional segments of hair N of the individual I until the desired amount of pressed hair wefts 10' have been applied to the natural hair N.

Typically, the pressed wefts 10', when utilized as hair extensions, remain on the head of the individual I for six to eight weeks. As this time elapses, the wefts 10' "grow" away from the head of the individual I along with growth of the natural hair N. Thus, to preserve the appearance of the "extended" hair, the wefts 10' must be adjusted at the end of this period. To raise the wefts 10', initially the weave 50 of each weft 10' is peeled away from the contact surface 82 of the tape 80. Because the vinyl composition 100 does not come into direct contact with the pressed weave 50', the weft 10' is not damaged during this removal process.

The weft 10' is then carefully combed and additional hair attachment tape 80 is applied to the pressed weave 50' for reuse of the weft 10'. The tape 80 remains bonded to the natural hair N of the individual I until an appropriate solvent is utilized to dissolve the vinyl composition 100, allowing the tape 80 to be removed from the natural hair N. The natural hair N is then carefully combed and parted for reattachment of the wefts 10' at a location closer to the individual I than that exhibited when the wefts 10' are removed.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A method for manufacturing a hair weft having a plurality of individual hairs attached to a weave extending perpendicular to the individual hairs, the method including the steps of:

interweaving the individual hairs with fibers of the weave, applying a bonding composition to the weave, and bonding attached ends of the individual hairs to the fibers of the weave with the bonding composition, wherein said interweaving step includes the step of orienting the individual hairs perpendicular to a length of the weave, wherein said applying step includes the step of including a polyvinyl chloride compound within the bonding composition, the bonding composition bonding the fibers of the weave to the attached ends of the hair, including the further step of drying the bonding composition, including the further step of applying an additional layer of bonding composition to the weave, including the further step of pressing the vinyl composition between two platens, each platen having a planar surface addressing the weave and pressing the weave and included vinyl composition into a thin flexible weave, wherein said pressing step includes steps of clamping the platens together and waiting for a time not less than a time necessary to fix the weave at a new lesser thickness, wherein said bonding step includes bonding the attached ends of the hairs to the fibers of the weave in a manner preserving flexibility of the weave, including the further steps of:

applying a bead of bonding composition to a vinyl substrate, placing the hair weft over the bead with the hairs of the hair weft addressing the bead between the attached end and a free end, pressing the hair into the bead with a polyethylene strip, and cutting the hair within the hair weft between the bead and the weave;

whereby the hair weft is attached to a vinyl substrate for placing upon the head of a person without the weave included thereto.

2. A method for attaching a hair weft to a substrate for use upon a person to be treated, the steps including:

providing a pressed hair weft with a plurality of substantially parallel individual hairs having an attached end connected to a pressed weave extending perpendicular to the individual hairs, placing a bead of vinyl composition on the substrate, placing the weft adjacent the bead with the weave above the bead and free ends of the individual hairs below the bead, and severing the weave from the weft above the bead;

whereby the individual hairs are attached to the substrate without the weave remaining attached to the individual hairs.

3. The method of claim 2, wherein said placing a bead step includes extending the bead to have a length similar to a length of the weave.

4. The method of claim 3 including the further step of pressing the individual hairs toward the bead and the substrate at a location adjacent the bead with a polyethylene strip, the polyethylene strip forcing the hairs to come into contact with the bead.

5. The method of claim 4 including the further step of forming the vinyl composition to include both a polyvinyl chloride and a solvent in a liquid form that dries to a solid form with exposure to air, the dried form of the vinyl composition remaining elastic.

6. A method for attaching a pressed hair weft to natural hair of an individual, the pressed hair weft including a plurality of individual hairs having attached ends and free ends opposite the attached ends, the attached ends bound together in substantially parallel relationship by a weave of fibers with an elastic polyvinyl chloride composition impregnated therewithin, the attaching method including the steps of:

applying tape to the weave with a contact surface of the tape adjacent the weave and an exposed surface opposite the contact surface, parting the natural hair of the individual between an upper hair segment and a lower hair segment, placing the weave adjacent the lower hair segment and adjacent the part with the tape on a side of the weave opposite the lower hair segment, applying bonding composition to the exposed surface of the tape, and pulling the upper hair segment down over the part and into contact with the bonding composition;

whereby the natural hair is bonded to the pressed hair weft.

7. The method of claim 6 including the further steps of: peeling the weave away from the tape and removing the pressed hair weft from the natural hair of the individual when removal is desired, repeating said tape applying step, and reattaching the pressed hair weft to an individual's natural hair; whereby the pressed hair weft is removeable and reusable.

8. The method of claim 7 including the further step of removing the bonding composition from between the exposed surface of the tape and the natural hair by applying a bonding composition solvent to the bonding composition.

* * * * *